US005983862A

United States Patent [19]

Nishiyama et al.

[11] Patent Number: 5,983,862

[45] Date of Patent: Nov. 16, 1999

[54] COMBUSTION CONTROL SYSTEM FOR INTERNAL COMBUSTION ENGINE

[75] Inventors: Ryoji Nishiyama; Hideaki Katashiba; Yoichi Kadota, all of Tokyo, Japan

[73] Assignee: Mitsubishi Denki Kabushiki Kaisha, Tokyo, Japan

[21] Appl. No.: 08/980,892

[22] Filed: Dec. 1, 1997

[30] Foreign Application Priority Data

Dec. 2, 1996 [JP] Japan ..... 8-321901

[51] Int. Cl.[6] ..... F02D 1/00; F02P 15/00

[52] U.S. Cl. ..... 123/406.26; 123/435

[58] Field of Search ..... 123/406.37, 406.26, 123/406.27, 406.12, 406.47, 406.19, 435, 436

[56] References Cited

U.S. PATENT DOCUMENTS

| | | | |
|---|---|---|---|
| 5,309,884 | 5/1994 | Fukui et al. | 123/481 |
| 5,337,716 | 8/1994 | Fukui et al. | 701/111 |
| 5,343,844 | 9/1994 | Fukui et al. | 123/481 |
| 5,396,176 | 3/1995 | Ishii et al. | 123/479 |
| 5,425,339 | 6/1995 | Fukui | 123/416 |
| 5,755,206 | 5/1998 | Takahashi et al. | 123/406.37 |

OTHER PUBLICATIONS

Ion–Gap Sensing For Engine Control, Automotive Engineering/Sep. 1995, pp. 65–68.

*Primary Examiner*—Willis R. Wolfe
*Assistant Examiner*—Hieu T. Vo
*Attorney, Agent, or Firm*—Sughrue, Mion, Zinn, Macpeak & Seas, PLLC

[57] ABSTRACT

A combustion control system includes a waveform shaping device for producing an ON signal from an ion current detected value, a down timing detecting device for detecting down timings of the ON signal, an operating device for converting the down timings into times elapsing from a reference crank angle, mask time section setting device for setting a mask time section corresponding to a combustion period in accordance with a running condition of the internal combustion engine, a selecting device for selecting at least one of said down times detected within the mask section, and a determining device for determining a combustion parameter of said internal combustion engine in accordance with the combustion ending time, whereby the combustion state of each cylinder is detected from the combustion ending time detected by the mask time section to determine the combustion parameter so as to suppress a combustion change. In this configuration, by operating a small quantity of data, an inexpensive and accurate combustion control system for an internal combustion engine can be obtained.

9 Claims, 8 Drawing Sheets

COMBUSTION CONTROL SYSTEM FOR INTERNAL COMBUSTION ENGINE

BACKGROUND OF THE INVENTION

The present invention relates to a combustion control system which can perform optimum combustion control with harmful exhaust gas reduced by detecting the combustion state of each cylinder on the basis of an ion current detected value to suppress a combustion change, and more particularly to a combustion control system which can realize the combustion control with high reliability with no increase in cost.

It is generally known that during combustion of an internal combustion engine, conductive radical composition is produced in a flame so that the combustion state can be detected in terms of an ion current.

Specifically, with an internal wall of an engine combustion chamber and an ignition plug in the chamber used as electrodes for detecting the ion current, if a prescribed voltage is applied between both electrodes (internal wall and ignition plug), the ion current flows between both electrodes when the flame in combustion passes between the electrodes.

Further, when the flame burns to extend, the radical density existing between both electrodes is apt to change in accordance with a combustion state. For this reason, it is also known that the detected value of the ion current changes according to the extension of flame leading to a change in the combustion state and also according to the shape of the flame. Therefore, using such a property of the ion current, the combustion state of the internal combustion engine can be detected.

FIG. 8 is a waveform chart showing the time change in an ion current Io which is detected during combustion in a cylinder.

As seen from FIG. 8, the ion current Io represents an output waveform having plural maximum values within a slight change. This output waveform occurs during the period of main flame propagation in the combustion flame in the internal combustion engine.

Commonly, ignition timing Ts is set at a more leading angle side than the crank angular position of TDC. At the time of ignition, combustion starts from the area in proximity to the ignition plug to generate ions. The ion current Io, therefore, has a maximum peak at the ignition time before TDC.

Further, the combustion expands at the crank angular position after TDC to provide a maximum quantity of ions at a portion separate from the ignition plug. Thus, the ion current Io reaches its maximum value.

Ions remain also during the period (several msec or so) after completion of combustion. Therefore, because of air movement within the combustion chamber, the detected value of the ion current Io changes to converge.

Also after the period of main flame propagation is completed, the fuel in a liquid state attached to the internal wall of the combustion chamber is vaporized so that a small flame called "after-burning" which does not contribute to an output torque is created. Correspondingly, the ion current Io is detected.

It is also known that several kinds of waveform processing for the detected value of the ion current Io provide a characteristic value greatly correlated with the combustion state.

A previously known technique of controlling an internal combustion engine using the above characteristic of the ion current Io is disclosed in e.g. JP-A-6-42384.

FIG. 9 is a schematic arrangement view of the internal combustion engine control system disclosed in the above publication. Reference numeral 100 denotes an internal combustion engine; 101 an air intake system for supplying fuel and air to the engine; 102 a throttle valve provided within the air intake system 101 to respond to an accelerator pedal (not shown); 103 a surge tank provided on the downstream side of the throttle valve; 104 an air intake manifold communicating with the surge tank 103; 105 a fuel injection valve on the downstream side of the air intake manifold 104.

Reference numeral 106 denotes a cylinder of the engine 100; 107 an ignition plug provided within the combustion chamber of the cylinder 106; and 108 and 109 an intake tube and an exhaust tube attached to the cylinder 106, respectively. The intake tube 108 opens/closes the cylinder on the side of the air intake system. Reference numeral 110 denotes an exhaust system communicating with the exhaust tube 109. The exhaust system opens/closes the cylinder 106 on the side of the intake system 101. Reference numeral 111 denotes a catalyst provided on the downstream side of the exhaust system 110 to clean the exhaust gas.

Reference numeral 112 denotes an air/fuel sensor for detecting the air/fuel ratio h on the basis of the oxygen density within the exhaust system 110; 113 a water temperature sensor for detecting the cooled water temperature e of the engine; 114 an idle switch for detecting the complete closed state of the throttle valve 102; 115 an intake air pressure sensor for detecting the intake air pressure a within the air intake system 101; and 116 a revolving speed sensor for detecting a revolving speed b of an engine; and 117 a vehicle speed sensor for detecting a vehicle speed c.

Reference numeral 10 denotes a vehicle-loaded electronic control unit (ECU) of a microcomputer. On the basis of the items of detected information a to f from the several kinds of sensors 112 to 117, the ECU 10 produces a fuel injection signal F (which serves to determine a fuel injection timing and a fuel injection quantity) for the fuel injection valve 105 and an ignition driving signal Q (which serves to determine the ignition time).

The ECU 10 includes a CPU 11 for performing several kinds of arithmetic processing on the detected items of information a to f from the several kinds of sensors, an RAM 12 serving as a memory during arithmetic processing in cooperation with the CPU 11, an input interface 13 for taking in the detected items of information a to f, and an output interface 14 for producing the fuel injection signal F and the ignition driving signal Q, whereby the several parameters of the engine are controlled by the arithmetic processing corresponding to a running condition.

Reference numeral 23 denotes a current backflow preventing diode for detecting an ion current connected to the ignition plug 107; and reference numeral 24 denotes a biasing power source for passing an ion current. These components constitutes an ion power source detecting means in cooperation with the ECU 10.

The ECU 10 also includes an ROM (not shown) storing an operation program previously. Using this operation program, the ECU 10 produces the fuel injection signal F and ignition driving signal Q optimal to a running condition on the basis of the outputs a to f from the several kinds of sensors to drive the injection fuel valve 105 and ignition plug 107.

The ECU 10 detects the combustion state such as a misfire on the basis of the detected value of the ion current Io, and stops the combustion injection signal F for detection for the misfire to make the control of cutting the combustion.

In FIG. 9, although the concrete construction of the ion current detecting means is not shown, it should be noted that when the ion current is passed through the biasing power source 24 and the backflow preventing diode 23, the detected value of the ion current Io is supplied to the ECU 10.

In the ion current detecting technique disclosed in JP-A-6-42384, the analog value of the ion current Io is A/D converted by the ECU 10 to provide a large quantity of digital data which is in turn stored in the RAM 12 of a large capacity of memory. In this technique, these digital data will be subjected to arithmetic processing.

Incidentally, an exemplary concrete construction of the system for detecting the ion current from the combustion chamber of a vehicle-loaded internal combustion engine is shown in a misfire detecting circuit disclosed in JP-A-2-104978.

In this device, however, the detected value of the ion current Io is given as an analog voltage. Therefore, in order to perform the signal processing accurately using a vehicle loaded digital computer, the analog signal must be A/D converted by sampling for each 1° or so in terms of the crank angle of the internal combustion engine.

The large quantity of digital data thus A/D converted are once stored in the RAM 12, and are subjected to arithmetic processing at a high speed within a period until next combustion. However, this requires a very large amount of memory capacity. For this reason, it is difficult to perform this arithmetic processing by "one chip microcomputer" for controlling a vehicle loaded engine.

As described above, the conventional combustion control system for an internal combustion engine must process the large amount of digital data on the ion current detected value, and hence cannot realize the combustion control with high reliability.

SUMMARY OF THE INVENTION

The present invention has been accomplished in order to solve the problem described above. An object of the present invention is to provide a combustion control system for an internal combustion engine which can perform optimum combustion control with harmful exhaust gas reduced with no increase in cost.

In order to attain above object, in accordance with the present invention, there is provided a combustion control system comprising ion current detecting means provided in a combustion chamber of an internal combustion engine to detect an ion current; waveform shaping means for producing an ON signal during the time section while a detected value of the ion current is larger than a threshold value; down timing detecting means for detecting down timings when the ON signal shifts from ON to OFF; down time operating means for converting the down timings into down times elapsing from a reference crank angle generating time; mask tire section setting means for setting a mask period corresponding to a combustion period in accordance with a running condition of the internal combustion engine; combustion ending time selecting means for selecting at least one of the down times detected within the mask time section as a combustion ending time; and a combustion parameter determining means for determining a combustion parameter of the internal combustion engine in accordance with the combustion ending time.

In this configuration, the combustion state of each cylinder is detected from the down timings (combustion ending times) of the ON signal within the mask time section to determine the combustion parameter so as to suppress a combustion change. For this reason, the combustion control system capable of realizing accurate combustion control with no increase in cost using a small quantity of data can be provided.

Preferably, the reference crank angle generating time is an ignition time of the internal combustion engine. Because of this configuration, the combustion ending time can be operated accurately to provide a combustion control system with great reliability.

Preferably, a condition for defining the mask time section includes the revolving speed or load of the internal combustion engine. In this configuration, the mask time section is prolonged as the revolving speed and load increases, thereby providing a combustion control system with great reliability.

Preferably, the combustion parameter includes a fuel injection quantity, a fuel injection time, ignition time, EGR gas quantity and intake air quantity. This configuration provides a combustion control system with optimum combustion control.

Preferably, the combustion ending time selecting means selects the down time on the side of the most retarding angle as the combustion ending time. This configuration provides a combustion control system with optimum combustion control realized.

Preferably, the combustion parameter determining means comprises: a combustion change quantity operating means for operating the combustion change quantity for each combustion cycle of the combustion ending time; and a combustion parameter correcting means for correcting the combustion parameter in accordance with the combustion change quantity. This configuration provides a combustion control system with optimum combustion control realized in accordance with a combustion state.

Preferably, the combustion change quantity operating means includes a filter processing means for operating the average value of the combustion ending time, and takes a deviation of a present combustion ending time from the average value as the combustion change quantity; and the combustion correcting means incrementally corrects the fuel injection quantity of the combustion parameter by a prescribed quantity when the combustion change quantity exceeds a predetermined value, and decrementally corrects the fuel injection quantity as the prescribed quantity when the state showing that the combustion change quantity is not larger than the prescribed value succeeds by a prescribed number of times. This configuration provides a combustion control system with optimum combustion control realized in accordance with a combustion state.

Preferably, the combustion control system for an internal combustion engine further comprises down timing detecting means for detecting a down timing when the ON signal shifts from OFF to ON, complete misfire deciding means for producing a complete misfire decision signal when the up timing is not detected within the mask section, and combustion control inhibiting means for producing a combustion control inhibition signal in response to the complete misfire decision signal. In addition, the combustion parameter correcting means stops correction of the combustion parameter in response to the combustion control inhibition signal. This configuration provides a combustion control system for an internal combustion engine which can provide erroneous control in a complete misfire state.

Preferably, the internal combustion engine is an in-cylinder injection type internal combustion engine which directly injects fuel into the combustion chamber, and the mask time section is corrected in accordance with at least one of the fuel injection time and fuel injection quantity of the internal combustion engine. This configuration applied to the in-cylinder injection type internal combustion engine provides a combustion control system with optimum combustion control realized in accordance with a combustion state.

The above and other objects and features of the present invention will be more apparent from the following description taken in conjunction with the accompanying drawings.

DESCRIPTION OF THE PREFERRED EMBODIMENTS

Embodiment 1

Figure 1:
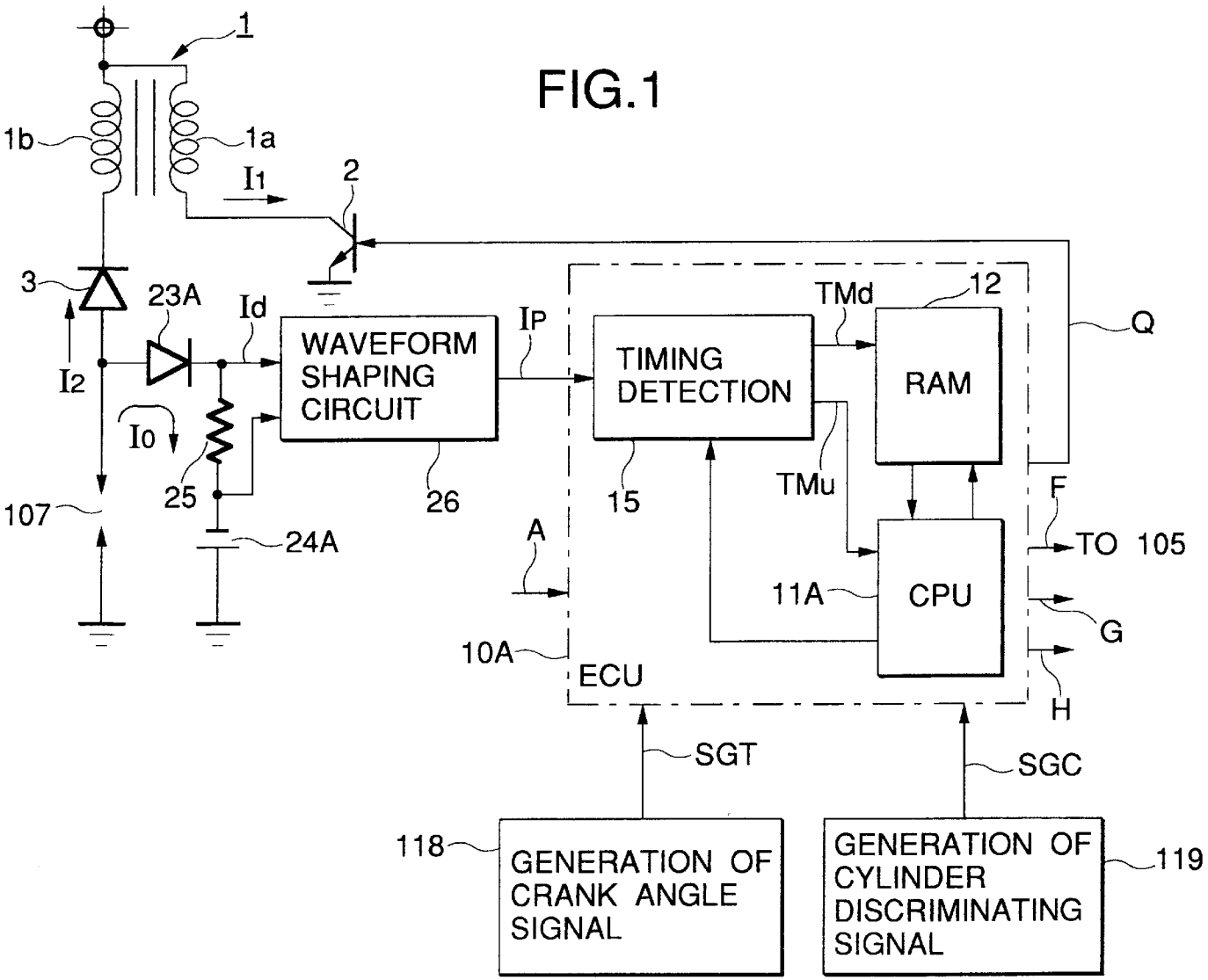
FIG. 1 is an arrangement view of a main part of a first embodiment of the present invention.

FIG. 1 is an arrangement view of a main part of a first embodiment of the present invention. Reference numerals 10A, 11A, 23A and 24A correspond to ECU 10, CPU 11, current backflow preventing diode 23 and a biasing power source 24, respectively which have been described in connection with FIG. 9. Reference numerals 12, 107, F, Io and Q refer to like elements described previously.

Figure 2:
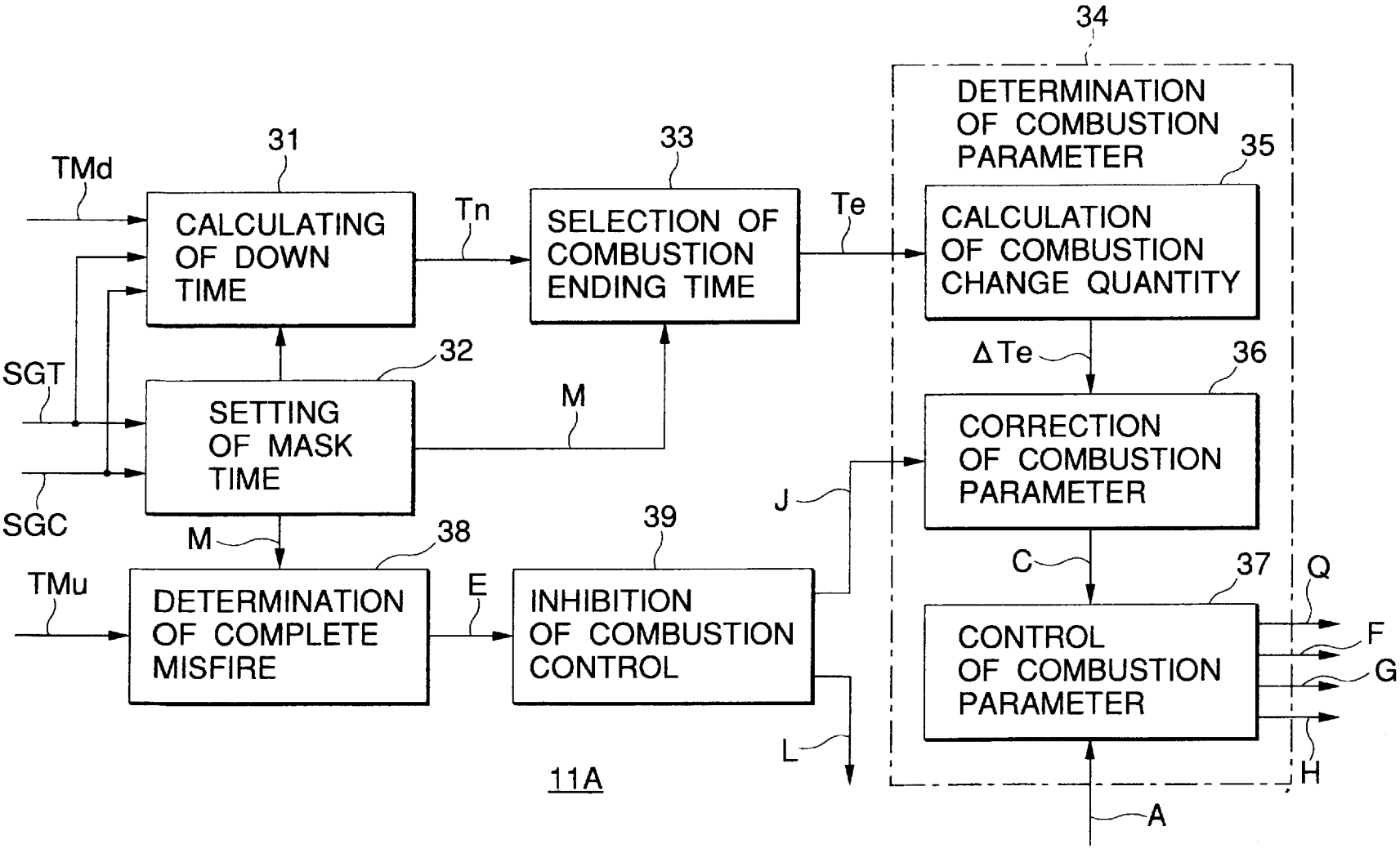
FIG. 2 is a functional block diagram showing an concrete arrangement of CPU in FIG. 1.
Figure 3:
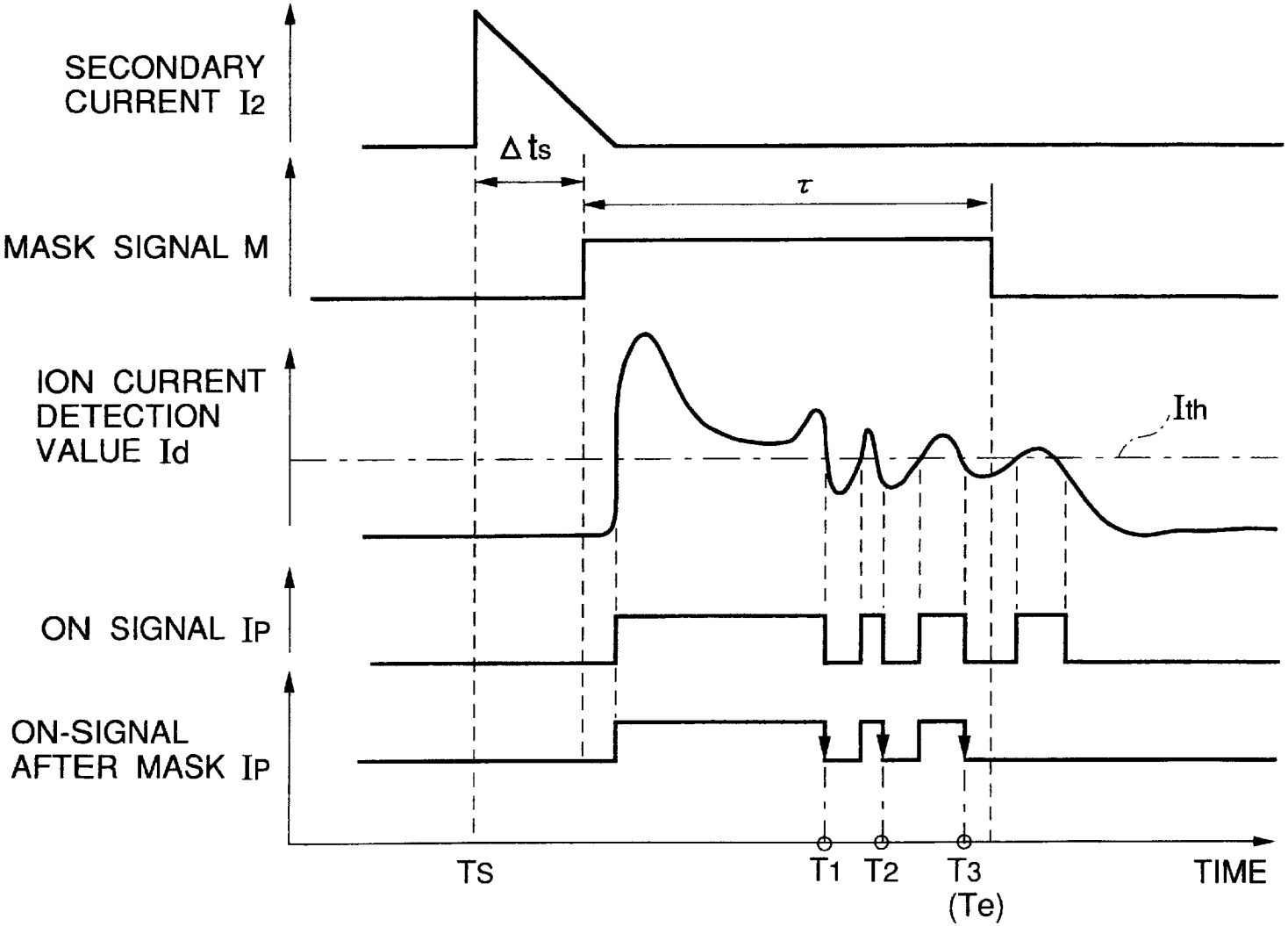
FIG. 3 is a timing chart for explaining the waveform shaping operation of the ion current detected value according to the first embodiment.

FIG. 2 is a functional block diagram showing an concrete arrangement of CPU 11A in FIG. 1. FIG. 3 is a timing chart for explaining the processing operation according to the first embodiment. FIG. 3 illustrate the pulse processing operation of an ion current detected value by a waveform shaping circuit and the operation of selecting a combustion ending time by an ECU 10A.

Figure 4:
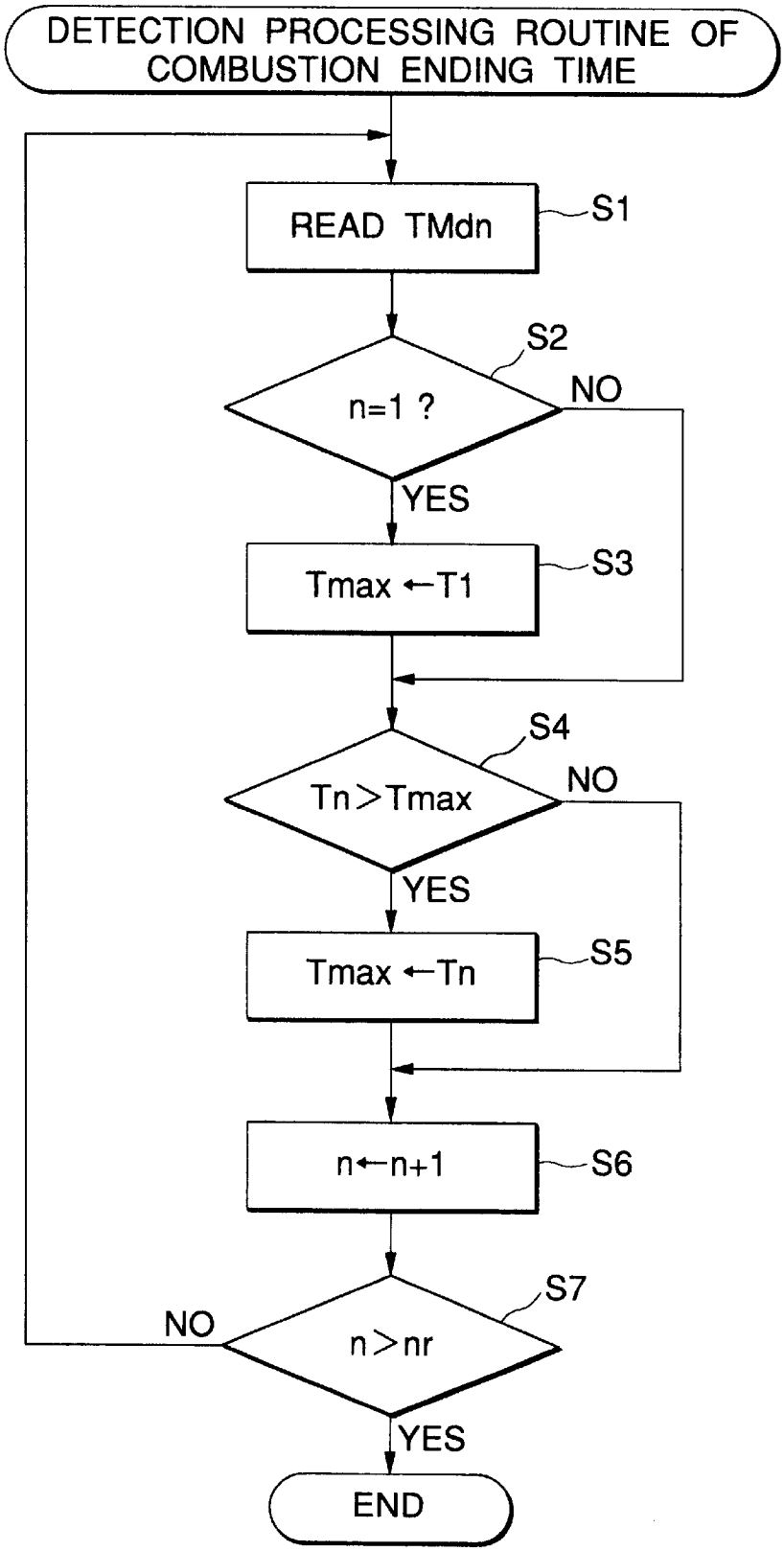
FIG. 4 is a flowchart showing the operation of detecting the combustion ending time according to the first embodiment.
Figure 5:
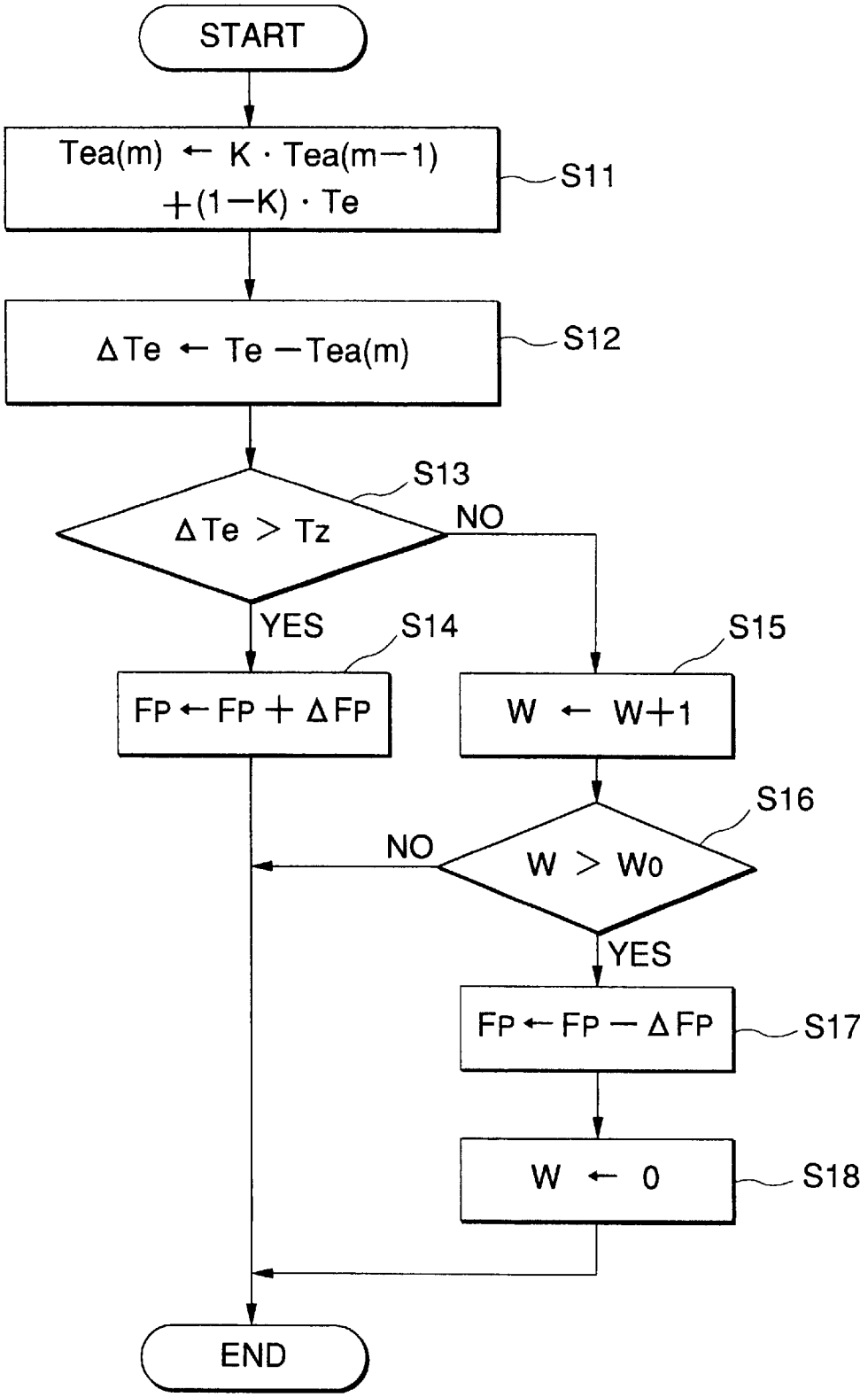
FIG. 5 is a flowchart of the operation of correcting a fuel injection quantity corresponding to a combustion change according to the first embodiment.

FIGS. 4 and 5 are flowcharts showing the processing operation in CPU 11A. Specifically, FIG. 4 shows a processing routine for detecting a combustion ending time. FIG. 5 shows a processing routine for correcting a combustion parameter on the basis of a change in the combustion ending time.

Figure 9:
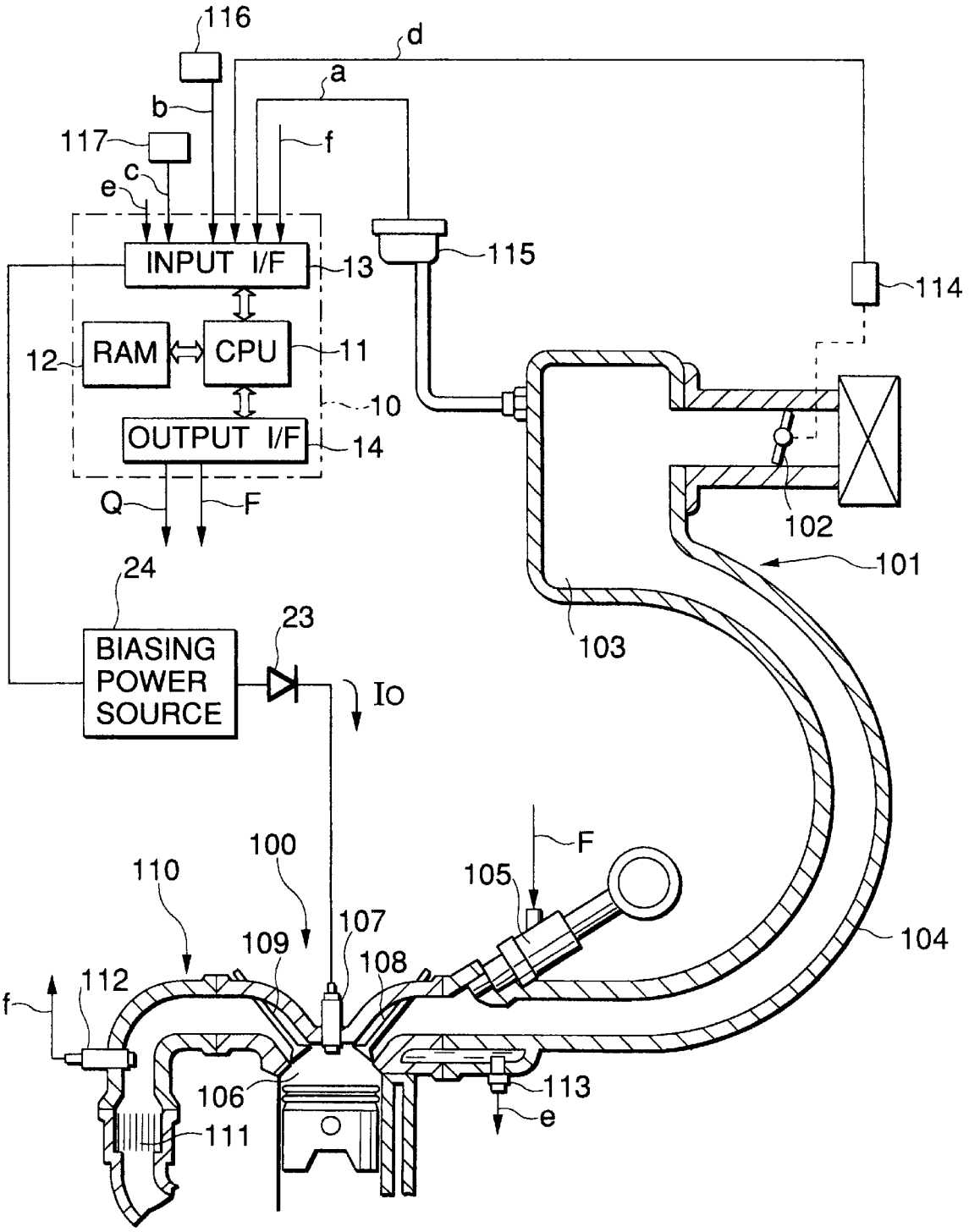
FIG. 9 is a schematic arrangement view of a conventional combustion control system for an internal combustion engine including an ion current detecting function.

In FIG. 1, ECU 10A is similar to the corresponding component in FIG. 9 except that it includes a timing detection means 15 on the input side and CPU 11A has a slightly different function. The arrangement not shown in FIG. 1 is the same as in FIG. 9.

Therefore, it is assumed that ECU 10A includes an input interface 13 and output interface 14 (FIG. 9) to take in the detected items of information from the several kinds of sensors and produce the driving signals for several kinds of actuators.

In FIG. 1, reference numeral 1 denotes an ignition coil having a primary coil 1*a* and a secondary coil 1*b*. A primary current I1 flowing through the primary coil 1*a* is passed or interrupted to generate a high ignition voltage having a negative polarity, thereby passing a secondary current.

Reference numeral 2 denotes a power transistor emitter-grounded for passing/ interrupting the primary current I1. Its collector is connected to the input terminal of the primary coil 1*a*.

Reference numeral 3 denotes a backflow preventing diode inserted on the side of the output terminal of the primary coil 1*b*. In order that the secondary current I2 flows in a forward direction, the anode side is connected to the one terminal of an ignition plug.

The ignition coil 1, power transistor 2 and ignition plug 3 constitute an ignition plug. Although the ignition time section is represented for a single cylinder in FIG. 1, it is assumed that the same ignition time section is provided for each cylinder.

Reference numeral 23A denotes a backflow preventing diode 23A. Its anode side is connected to the one terminal of the ignition plug 107 so that the ion current Io flows in a forward direction.

Reference numeral 24A denotes a biasing power source 24A. Its negative electrode is connected to the cathode of the backflow preventing diode 23A whereas its positive electrode is grounded.

Reference numeral 25 denotes a load resistor for converting the ion current into a voltage to provide a detected value Id. The backflow preventing diode 23A is inserted between the backflow preventing diode 23A and the biasing power source 24A.

The backflow preventing diode 23A, biasing power source 24A and load resistor 25 constitute an ion current detecting means.

Reference numeral 26 denotes a waveform shaping circuit for converting the detected value Id of the ion current into a pulse signal. The waveform shaping circuit 26 produces an "ON" signal Ip during the period while the detected value Id of the ion current is larger than a prescribed threshold voltage Ith (see FIG. 3). The "ON" signal Ip is supplied to a timing detecting means 15 in ECU 10A.

Under the control by CPU 11A, the timing detecting means 15 detects falling or down timings TMd when the "ON" signal shifts from "ON" to "OFF", and detects rising or up timings TMu when it shifts form "OFF" to "ON".

The down timings TMd are stored in RAM 12 cooperating with CPU 11A in the order of detection and the up timing timings TMu are directly inputted into CPU 11A.

Reference numeral 118 denotes a crank angular signal creating means for creating a crank angular signal SGT corresponding to the reference position of each cylinder. Reference numeral 119 denotes a cylinder discriminating signal creating means for creating a cylinder discriminating signal SGC corresponding to a specific cylinder. These means can be constructed by a single crank angle sensor (not shown) attached to the cam shaft of an engine.

The crank angle signal SGT and cylinder discriminating signal SGC are supplied to ECU 10A together with other several kinds of detected information A (outputs from several kinds of sensors in FIG. 9).

CPU 11A within ECU 10A determines at least one of combustion parameters inclusive of a fuel injection quantity, fuel injection time, ignition time, EGR gas quantity and intake air quantity, and supplies an ignition driving signal Q, fuel injection signal F, EGR driving signal G and air valve driving signal H to several actuators in the internal combustion engine through a driving circuit (not shown).

As seen from FIG. 2, CPU 11A includes a down timing operating means 31 for converting the down timing TMd into time information, a mask time section setting means 32 for setting a mask time section τ (see FIG. 3) to detect the down timing, a combustion ending timing selecting means 33 for selecting a combustion ending time Te from the down time Tn, and a combustion parameter determining means 34 for determining a combustion parameter according to a running state.

The combustion parameter determining means 34 includes a combustion change quantity operating means 35 for operating the combustion change quantity ΔTe for each combustion cycle of the combustion ending time Te, a combustion parameter correcting means 36 for correcting the combustion parameter in accordance with the combustion change quantity ΔTe, and a combustion parameter control means 37 for producing the corrected combustion parameter in response to a correction signal C from the combustion parameter correcting means 36. The The combustion change quantity operating means 35 includes a filter processing means for operating the average value of the combustion times Te detected until this time. It is assumed that a difference between the average value Tea and the combustion ending time at this time is a combustion change ΔTe.

When the combustion change ΔTe exceeds a predetermined value Tz, the combustion parameter correcting means 36 incrementally corrects the combustion injection quantity Fp of combustion parameters by a prescribed quantity ΔFp. On the other hand, when the state in which the combustion change quantity ΔTe is not larger than the prescribed value Tz succeeds a predetermined number of times Wo or greater, the combustion parameter correcting means 36 decrementally corrects the fuel injection quantity by a prescribed quantity ΔFp.

CPU 11A includes a complete misfire deciding means 38 for producing a complete misfire decision signal E at the time of complete misfire decision and a combustion control inhibiting means 39 for producing a combustion control inhibiting signal J in response to the complete misfire decision signal E.

The combustion parameter correcting means 36 within the combustion parameter determining means 34 stops the correcting operation based on the combustion change quantity ΔTe in response to the combustion control inhibition signal J.

Now referring to FIGS. 1 to 3 and FIG. 9, an explanation will be given of the operation of CPU 11A according to the first embodiment.

First, when the secondary current I2 is passed/interrupted by the ignition driving signal Q so that the ignition plug 107 makes an ignition, combustion is started immediately to generate ions in a cylinder. As a result, the ion current Io (FIG. 3) flows through the biasing power source 24A.

The ion current Io is detected through the load resistor 25. The detected ion current Io is converted into the "ON" signal Ip through the waveform shaping circuit 26, and the "ON " is supplied to the timing detecting means 15 within ECU 10.

In this case, during the time sections when the ion current detected value Id (analog signal voltage) is larger than a prescribed threshold voltage Ith, the waveform shaping circuit 26 produces the "ON" signal to be supplied to the timing detecting means 15 within the ECU 10A.

The timing detecting means 15 detects the down timings TMd and up timings TMu of the "ON" signal which are to be input to the CPU 11A.

The down timings TMd are once stored in the RAM 12 in their order of detection and thereafter read out by the down time operating means 31 within the CPU 11A.

The down time operating means 31 converts the down timings TMd into time information to operate the down time Tn from a reference crank angle generating time.

In this case, the reference crank angle generating time for operating the down time Tn is previously set at the ignition time Ts of an internal combustion engine (see FIG. 3), i.e. about B15° (which is a crank angular position on the leading angle side from TDC by 15°) on the basis of the crank angle signal SGT and cylinder discriminating signal SGC.

The mask time section setting means 32 produces a pulse-shaped mask signal M for setting the mask time section τ corresponding to the combustion period immediate after ignition control.

The mask time section τ is set according to the combustion period of main flame propagation in order to take only the down timings TMd effective as an operation processing object.

Therefore, only the ion current detected value Id generated during the mask time section τ is effective, and the detected value Id generated during the noise period which is not relevant to the engine output is excluded from the operation processing object.

Incidentally, the mask time section τ, which is set as a time section corresponding to the crank angular position, can be variably set in accordance with the running condition of the internal combustion engine (e.g. engine revolving speed). For example, the down timing (ending time) of the mask signal M is set at A50°–A70° (crank angular position on the retarding angle side from TDC by 50°–70°) or so.

The mask signal M, as seen from FIG. 3, rises after elapse of a minute time Δts from the prescribed ignition time Ts (reference crank angle generating time) and is at "H" level over the mask time section τ corresponding to an actual combustion period.

The combustion ending time selecting means 33 regards effective only the down times T1 to T3 of the ON signal Ip detected within the mask period τ, and select at least one of them, e.g. the down time T3 on the most retarding angle side as a combustion ending time Te.

Thus, all the down times detected after the time (Ts +Δts +τ) in which noise may be included are made invalid, thereby preventing attenuation in reliability due to noise.

The combustion parameter control means 37 within the combustion parameter determining means 34 determines the combustion parameter of the internal combustion engine on the basis of several kinds of detected information A indicative of the running state, and corrects the combustion parameter on the basis of the correction signal C from the combustion parameter correcting means 36.

Specifically, the combustion parameter control means 37, on the basis of the correction signal C according to the combustion change quantity ΔTe, corrects at least one of the ignition driving signal Q (ignition time), fuel injection signal F (fuel injection quantity and fuel injection time), EGR driving signal G (EGR gas quantity) and air valve driving signal H (intake air quantity).

Thus, appropriately correction-driven are at least one of the power transistor 2 for driving the ignition plug 107 of each cylinder, fuel injection valve 105 (FIG. 9) attached to the intake port of each cylinder, an EGR valve (not shown) attached between the exhaust tube and intake tube, and air valve (not shown) which bypasses the throttle valve 102 (see FIG. 9) within the intake tube to control the intake air quantity.

On the other hand, if the down timing TMu is not detected within the mask time section τ, the complete misfire deciding means 38 produces the complete misfire decision signal E, and the combustion control inhibiting means 39 produces the combustion control inhibit signal J. Thus, the function of the combustion parameter correcting means 36 within the combustion parameter determining means 34 is invalidated.

In the combustion control inhibiting state due to such complete misfire, the combustion parameter determining means 34 may set e.g. the combustion parameter at a fixed value.

Further, when the complete misfire decision signal E is inputted repetitively, the combustion control inhibiting means 39 produces the warning driving signal L to drive a warning means (not shown). Thus, a driver is warned of the complete misfire state to urge him to take suitable processing.

The description was made about a single cylinder. But in a multi-cylinder also, the CPU 11A within the ECU 10A executes the operation program within the ROM, makes discrimination of each cylinder on the basis of the cylinder discriminating signal SGC and detects the combustion ending time Te for each cylinder, which is to be stored in the RAM In this case, the CPU 11A selects as the combustion ending time Ts the down time on the most retarding angle side (most remote from the ignition time Ts) within the mask time section τ.

Now, referring to the flowchart of FIG. 4, an explanation will be given of the selection processing program of the combustion ending time Te by the CPU 11A.

The processing routine of FIG. 4 will be started at a prescribed crank angle of each cylinder by interruption from the crank angle signal SGT and cylinder discriminating signal SGC.

Incidentally, in the combustion ending time selecting means 33, the counter n for counting the number of times of detecting the down time Tn is initialized (reset) at n=1 before the processing routine of FIG. 4 is started.

First, the down time operating means 31 reads the n-th down timing TMdn in the counter n from the RAM 12 (step S1) to operate the down time Tn relative to the ignition time Ts.

The combustion ending time selecting means 33 decides whether or not the number of times n of detection of the down time Tn within the mask time section τ is 1. If n=1 (i.e. YES), the first down time T1 is set as the maximum value Tmax (step S3).

On the other hand, in step S2, if n>1 (i.e. NO), whether or not the n-th down time Tn has exceeded the maximum value Tmax is decided (step S4). If Tn>Tmax (i.e. YES), the n-th down time Tn is taken as the maximum Tmax.

In step S4, if Tn<Tmax (i.e., NO), the counter n for detecting the number of times is incremented (n←n+1) (step S6), and whether or not the counter n is larger than a limit value nr (step S7).

If n>nr (i.e. YES), the processing routine of FIG. 4 is ended. If n<nr (i.e. NO), the routine is returned to step S1 to repeat S1 to S7.

The maximum value Tmax thus finally set corresponds to the down time on the most retarding angle side within the mask time section τ. The combustion ending time selecting means 33 selects this maximum value Tmax as the combustion ending time Te.

If the down timing TMd is never detected within the mask time section τ, the ending time of the mask time section τ is selected as maximum value Tmax as the combustion ending time Te.

Referring to the flowchart of FIG. 5, an explanation will be given of the operation program for controlling the combustion parameter by the combustion parameter determining means 34 within the CPU 11A. Like the processing routine of FIG. 4, the processing routine of FIG. 5 will be started at a prescribed crank angle of each cylinder by interruption from the crank angle signal SGT and cylinder discriminating signal SGC.

In the combustion parameter correcting means 36, it is assumed that the fuel correction elapse counter W for counting the fuel correction elapse time is cleared to W=0 before the processing routine of FIG. 5 is started.

First, the filter processing means within the combustion change quantity operating means 35 calculates the average value Tea on the basis of the combustion ending time Te detected until this time using the following Equation (1). (step 11)

$$\mathrm{Tea}(m)=K\cdot\mathrm{Tea}(m-1)+(1-K)\cdot Te \tag{1}$$

In Equation (1), Tea represents an average value of the combustion ending times acquired by the present calculation; Tea(m−1) represents the average value acquired by the calculations until the previous calculation; and K represents a filter coefficient used for primary filter operation which is set in the range of 0<K<1. The combustion ending time Te is represented by an instantaneous value detected in the combustion cycle immediate before the present processing routine is executed.

The combustion change quantity operating means 35 takes a deviation of the present combustion ending time Te from the average value Tea (m) to compute a combustion change quantity ΔTe using the following Equation (2) (step S12)

$$\Delta Te=Te-\mathrm{Tea}(m-1) \tag{2}$$

The combustion parameter correcting means 36 decides whether or not the combustion change ΔT (n) exceeds a prescribed value Tz corresponding to a permissible upper limit (step S13). If ΔTe>Tz (i.e. YES), because it is regarded as a combustion change has occurred which leads to the combustion ending time Te on the retarding angle side from the average value Tea(m) by the prescribed value Tz or more (i.e. the combustion period is longer than the average value), by the decision that the fuel supply quantity is insufficient, the fuel injection quantity Fp is incrementally corrected by a certain amount ΔFp as represented by the following Equation (3) (step S14).

$$Fp\leftarrow Fp+\Delta Fp \tag{3}$$

Thus, the fuel injection quantity Fp is increased to correct the air/fuel ratio on the "rich" side so that it is controlled to reduce the combustion change quantity ΔTe. Thereafter, the processing routine of FIG. 5 is ended.

On the other hand, in step S13, ΔTe≦Tz (i.e. NO), the fuel correction elapse time counter W is incremented (W←W+1) (step S15), and whether or not the fuel correction elapse time counter W has exceeded a prescribed number of times Wo is decided (step S16). It should be noted that the prescribed number of times Wo is previously set in accordance with a required specification and others.

In step S16, if W>Wo (i.e. YES), it can be regarded as a sufficient time has elapsed after the combustion injection quantity Fp has been corrected and hence the combustion is stable. Therefore, by the decision that the air/fuel ratio may be returned to the "lean" side, the fuel injection quantity is decrementally corrected by the prescribed quantity ΔFp (step S17).

$$Fp \leftarrow Fp - \Delta Fp \tag{4}$$

The fuel correction elapse counter W is cleared to zero (step S18). Thereafter, the processing routine of FIG. 5 is ended.

In this way, by acquiring the "ON" signal through the waveform shaping circuit 26 to detect the down timings TMd within the mask time section τ, the combustion state can be detected or controlled using a less quantity of memory capacity of the RAM 12.

More specifically, in the conventional control system, the ion current detected value Id (analog signal) is A/D converted over the time section of the single entire combustion and the converted digital value is stored in the RAM. On the other hand, in the control system according to the present invention, the detected current value Id, before being supplied to the ECU 10A, is once converted into the ON signal Ip (pulse signal) by the waveform shaping circuit 26 and only the down time Tn of the ON signal Ip is operated in the ECU 10A. For this reason, the capacity of the RAM 12 can be reduced greatly to relax the load for the ECU 10A.

Further, by setting the mask time section τ corresponding to the combustion period of an internal combustion engine, only the down timings TMd based on the detected value Id during the combustion period of flame propagation (relevant to the output torque) are subjected to arithmetic processing, but the detected value generated during the period including noise such as "after-burning" which is irrelevant to the output torque is excluded. This permits the combustion state to be detected or control with high reliability and at low cost.

Thus, it is possible to attain a stable combustion state without an increase in cost and make combustion control with high reliability. Accordingly, a combustion control system for an internal combustion engine can be realized which can minimize the exhaust of harmful combustion gas while maintaining drivability.

Before the processing routine of FIG. 5 is started, control inhibition decision may be made. If the up timing TMu of the ON signal Ip is not detected once by the timing detecting means 15, by decision of complete misfire, the control of the combustion parameter corresponding to the combustion ending time Te is inhibited so that the accuracy of detection/control can be further improved.

In the first embodiment, although the down timing detecting means and the up timing detecting means were constructed by the single timing detecting means 15, they may be individual timing detecting means.

Embodiment 2

In the first embodiment, although the reference crank angle generating timing was set at an ignition timing TS of about B15°, it may be set at the other crank angular position in relative proximity to the ignition time Ts.

Further, in order to optimize the combustion control, the fuel injection quantity Fp was corrected incrementally or decrementally by a prescribed quantity ΔFp, it may be corrected by any prescribed quantity. For example, in early stages of correction, it can be corrected by a relatively large quantity, and in later stages it may be finely adjusted.

Embodiment 3

In the first embodiment, the fuel injection quantity Fp was taken as a combustion parameter to be correction-controlled. Namely, it was correction-controlled in accordance with the detection processing result (change quantity ΔTe of the combustion ending time Te) of the ion current Io. But, other combustion parameters (fuel injection time, ignition time, EGR gas quantity and intake air quantity) may be controlled to provide the same effect.

Embodiment 4

In the first embodiment, as the combustion ending time Te, the up time Tn detected on the most retarding angle side within the mask time section τ was selected. But any single up time detected within the mask time section τ may be selected or any plural up times may be selected.

Embodiment 5

In the first embodiment, although the setting condition of the mask time section used in selecting the combustion ending time Te was not actually explained, it may be corrected in response to the engine revolving speed and load.

An explanation will be given of the fifth embodiment of the present invention in which the ending time of the mask time section τ is corrected in accordance with the engine revolving speed and load.

Figure 6:
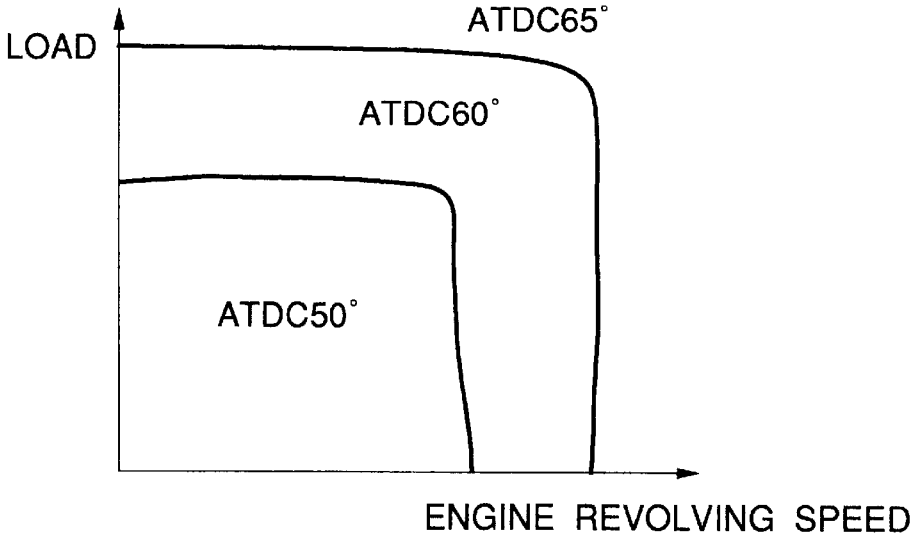
FIG. 6 is a graph showing the relationship between an engine revolving speed and load, and a mask interval according to the fifth embodiment of the present invention.

FIG. 6 explains the correction contents of the mask time section τ according to the fifth embodiment in which the ending times (crank angle position) of the mask time section τ for the engine revolving and load are represented by table data on a two-dimensional map.

As seen from FIG. 6, the ending time of the mask time section τ is set so that it is shifted towards the side of a retarding angle (e.g. A50°←A60°←A65°) as the engine revolving speed or load increases, thereby lengthening the mask time section τ.

Generally, the main combustion period in single combustion of the internal combustion engine varies according to the engine revolving speed and load. Therefore, by correcting the ending time of the mask time section in accordance with the engine revolving speed and load, the S/N ratio when the combustion change ΔTe based on the ion current Io is detected can be increased.

The means for detecting load may be previously known detecting means such as a throttle opening sensor for detecting the opening of the throttle valve 102, an intake air quantity detecting means, a pressure detecting means in an intake air tube, etc. This does not increase the cost.

Likewise, the means for detecting the engine revolving speed may be previously known devices such as means for detecting the ignition period of the ignition device installed in the internal combustion engine, means for detecting the revolving speed on a rotational angle sensor mounted on a crank shaft or cam shaft, etc.

Embodiment 6

Furthermore, in the first embodiment, although the control system was applied to the internal combustion engine with a fuel injection valve 105 provided in the intake air manifold 104, it may be applied to an in-cylinder injection type internal combustion engine in which fuel is directly injected into the combustion chamber of the cylinder 106.

An explanation will be given of the sixth embodiment applied to the in-cylinder injection type internal combustion engine.

Generally, the in-cylinder injection type internal combustion engine in which fuel is directly injected into the combustion chamber in a compression stroke has a characteristic that the combustion state is apt to depend on the fuel injection quantity and fuel injection time as compared with an intake-air injection type internal combustion engine.

Therefore, in the case of the in-cylinder injection type internal combustion engine, the mask time section $\tau$ is preferably corrected in accordance with, not only the revolving speed and the load of the engine, but also the control quantity of the fuel injection signal F (at least one of the fuel injection quantity and fuel injection time).

Figure 7:
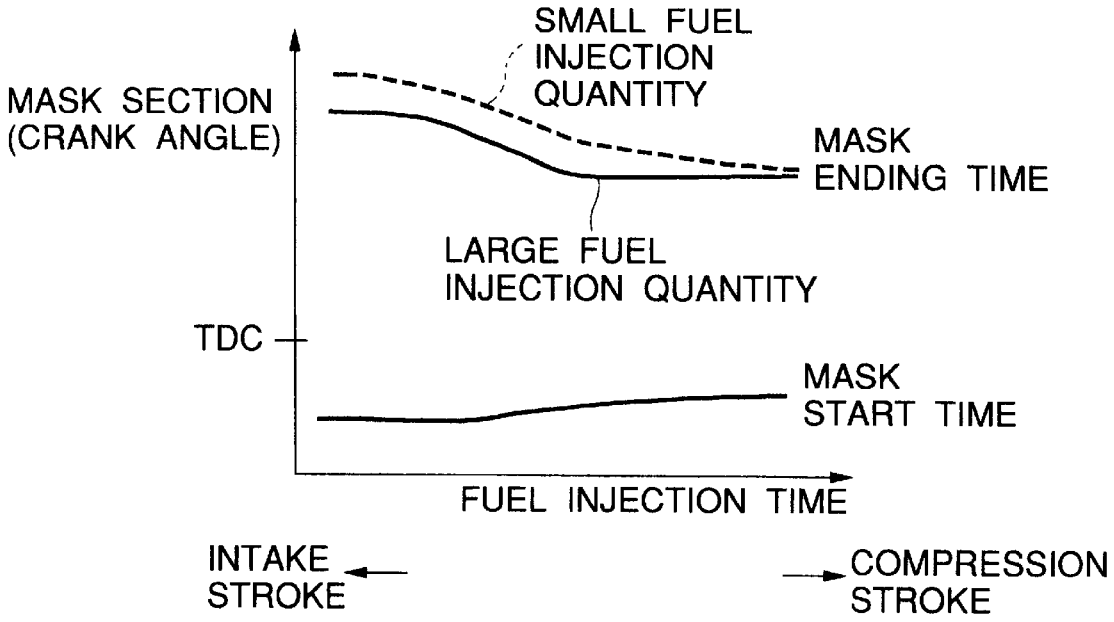
FIG. 7 is a graph showing the relationship between a fuel injection time and a mask time section according to the sixth embodiment of the present invention.
Figure 8:
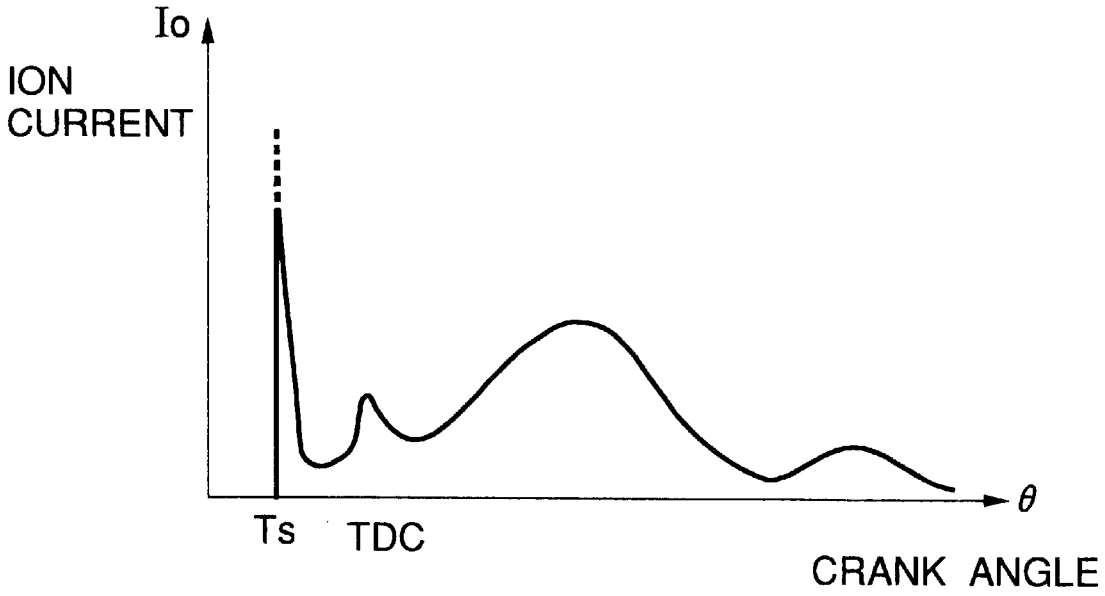
FIG. 8 is a waveform chart showing the analog detected value of a general ion current.

FIG. 7 explains the correction contents of the mask time section $\tau$ according to the sixth embodiment in which the starting time and ending time (crank angle position) of the mask time section $\tau$ for the fuel injection for the fuel injection time are illustrated as table data. In FIG. 7, solid line indicates the characteristic curve when the fuel injection quantity is great, and broken line indicates the characteristic curve when it is small.

The table data in FIG. 7 are used when the mask time $\tau$ is corrected in accordance with the fuel injection quantity and fuel injection time.

In FIG. 7, a stable combustion can be realized as the starting time of the mask time section $\tau$ approaches the crank angle of the crank angular position of combustion TOP (TDC) as a result that the fuel injection time is set on the side of the compression stroke. Thus, the mask time section $\tau$ can be shortened.

When the fuel injection quantity is decreased, the combustion period is prolonged. For this reason, like broken line, the ending time of the mask time section $\tau$ must be shifted to the retarding angle side.

However, where the fuel injection time is set on the compression stroke side, the combustion period is difficult to depend on the air/fuel ratio (i.e. fuel injection quantity), the incremental correction quantity of the mask time section $\tau$ is decreased.

In this way, using the map data of FIG. 7, the control system according to the present invention can be applied to the in-cylinder injection type internal combustion engine, thereby providing the same effect as described above.

What is claimed is:

1. A combustion control system comprising:

ion current detecting means provided in a combustion chamber of an internal combustion engine to detect an ion current;

waveform shaping means for producing an ON signal during a time section when a detected value of said ion current is larger than a threshold value;

down timing detecting means for detecting down timings when said ON signal shifts from ON to OFF;

down time operating means for converting said down timings into down times elapsing from a reference crank angle generating time;

mask time section setting means for setting a mask time section corresponding to a combustion period in accordance with a running condition of said internal combustion engine;

combustion ending time selecting means for selecting at least one of said down times occurring within said mask time section as a combustion ending time; and a combustion parameter determining means for determining a combustion parameter of said internal combustion engine in accordance with said combustion ending time.

2. A combustion control system for an internal combustion engine as claimed in claim 1, wherein said reference crank angle generating time is an ignition time of said internal combustion engine.

3. A combustion control system for an internal combustion engine as claimed in claim 1, wherein a running condition for defining the mask time section includes a revolving speed or load of the internal combustion engine.

4. A combustion control system for an internal combustion engine as claimed in claim 1, wherein said combustion parameter includes at lease one of a fuel injection quantity, a fuel injection time, ignition time, EGR gas quantity and intake air quantity.

5. A combustion control system for an internal combustion engine claimed in claim 1, wherein said combustion ending time selecting means selects the down time on a side of a most retarding angle from top dead center as said combustion ending time.

6. A combustion control system for an internal combustion engine as claimed in claim 1, wherein said combustion parameter determining means comprises:

a combustion change quantity operating means for operating a combustion change quantity for each combustion cycle of said combustion ending time; and a combustion parameter correcting means for correcting said combustion parameter in accordance with said combustion change quantity.

7. A combustion control system for an internal combustion engine claimed in claim 6, wherein said combustion change quantity operating means includes a filter processing means for operating an average value of said combustion ending time, and for taking a deviation of a present combustion ending time from said average value as said combustion change quantity; and said combustion correcting means incrementally corrects a fuel injection quantity of said combustion parameter by a prescribed quantity when said combustion change quantity exceeds a predetermined value, and decrementally corrects said fuel injection quantity as the prescribed quantity when a state showing that said combustion change quantity is not larger than the prescribed value succeeds by a prescribed number of times.

8. A combustion control system for an internal combustion engine as claimed in claim 6 further comprising:

complete misfire deciding means for producing a complete misfire decision signal when said down timing is not detected within said mask section, combustion control inhibiting means for producing a combustion control inhibition signal in response to said complete misfire decision signal, wherein said combustion parameter correcting means stops correction of said combustion parameter in response to said combustion control inhibition signal.

9. A combustion control system for an internal combustion engine as claimed in claim 1, wherein said internal combustion engine is an in-cylinder injection type internal combustion engine which directly injects fuel into said combustion chamber, and said mask time section is corrected in accordance with at least one of a fuel injection time and fuel injection quantity of said internal combustion engine.

* * * * *